US007819601B2

(12) United States Patent
Taniguchi

(10) Patent No.: US 7,819,601 B2
(45) Date of Patent: Oct. 26, 2010

(54) PRESSURIZED PEN

(75) Inventor: Shunichi Taniguchi, Saitama (JP)

(73) Assignee: Tombow Pencil Co., Ltd., Tokyo (JP)

( * ) Notice: Subject to any disclaimer, the term of this patent is extended or adjusted under 35 U.S.C. 154(b) by 142 days.

(21) Appl. No.: 12/215,824

(22) Filed: Jun. 30, 2008

(65) Prior Publication Data

US 2009/0060625 A1 Mar. 5, 2009

(30) Foreign Application Priority Data

Aug. 29, 2007 (JP) ..... 2007-222391

(51) Int. Cl.
*B43K 5/18* (2006.01)
*B43K 5/02* (2006.01)

(52) U.S. Cl. ..... 401/188 A; 401/101; 401/188 R

(58) Field of Classification Search ..... 401/187, 401/188 A, 188 R, 101, 209
See application file for complete search history.

(56) References Cited

U.S. PATENT DOCUMENTS 2,560,810 A * 7/1951 Morris ..... 401/188 R
3,285,228 A * 11/1966 Fisher ..... 401/101
3,516,754 A * 6/1970 Blanchard ..... 401/101
7,128,491 B2 * 10/2006 Kobayashi ..... 401/188 A
7,303,349 B2 * 12/2007 Murakoshi ..... 401/188 A
2008/0019761 A1 1/2008 Taniguchi

OTHER PUBLICATIONS

European Search Report dated Nov. 16, 2007.

* cited by examiner

*Primary Examiner*—Gregory L Huson
*Assistant Examiner*—Keegan Gumbs
(74) *Attorney, Agent, or Firm*—Scott D. Wofsy; Edwards Angell Palmer & Dodge LLP

(57) ABSTRACT

Provided is a pressurized pen, which is enabled to enhance the sealing property of a compression chamber at a pressurizing time in the knocking operation of a knock mechanism and to improve the durability. A pressuring pump mechanism includes: a pressure member having a front end opening portion communicating with the inside of a medium containing tube and a compression chamber made extensible and contractible in axial direction; and a push member for coming in axial direction into and out of abutment against a rear end opening portion of the pressure member and for pushing the compression chamber of the pressure member in a gas-tight condition in a compressing direction. The push member is associated with the pushing action of a knock mechanism such that it is enabled to irrotationally move toward the rear end opening portion of the pressure member.

6 Claims, 8 Drawing Sheets

PRESSURIZED PEN

FIELD OF THE INVENTION

The present invention relates to a pen such as a ball-point pen, a correction pen or a glue pen and, more particularly, to a pressurized pen which is enabled to prevent a pen, when used upward, from running out of a medium such as ink, a correction fluid or paste.

BACKGROUND OF THE INVENTION

The pressurized pen of the related art such as a ball-point pen has often encountered troubles such as failure of the ink to come out smoothly, from the pen tip of a pen refill unit, when used, a run out of the ink, while being used for writing in an upward position, inability to write or leakage of the ink from the rear end portion of the pen refill unit.

In the related art, on the contrary, the pen cylinder of the knock-type ball-point pen is loaded with a pen refill unit having a pen tip at the front end portion of a medium containing tube for containing a medium or ink, and a pressuring pump mechanism for pressurizing the inside of the rear end opening portion of the medium containing tube in that pen refill unit, and this pressuring pump mechanism is associated with a knock mechanism disposed in the rear end portion of the pen cylinder. By the pushing action of the knock rod, the pen refill unit is moved in the axial direction, and the pressuring pump mechanism is actuated to pressurize the inside of the rear end opening portion of the medium containing tube thereby preventing the run out of the ink as described in JP-A-2005-280119 or JP-A-2005-288794.

In the pressuring pump mechanism in the ball-point pen described in JP-A-2005-280119, a rotor for rotating in association with the knock mechanism is disposed to face a cylinder into which the medium containing tube of the pen refill unit is inserted, and a seal ring is interposed between the inner circumference of the cylinder and the outer circumference of the rotor whereas a seal member is interposed between the inner circumference of the cylinder and the outer circumference of the medium containing tube. As a result, the cylinder inside between the two seal portions is used as a compression chamber thereby keeping the sealing property so that the air in the compression chamber may be compressed by the movement of the rotor at the pressurizing time in the knocking operation of the knock mechanism.

In the aforementioned pressuring pump mechanism, however, the seal portion between the outer circumference of the rotor and the inner circumference of the cylinder acts as the rotational contact face on the axis, and the seal portion between the inner circumference of the cylinder and the outer circumference of the medium containing tube acts as a contact face for a sliding contact in the axial directions.

Therefore, the two seal portions slide and rub each other in each knocking operation of the knock mechanism so that they become loose or wear thereby raising problems that the sealing property drops during a long use, that the durability is deteriorated, and that the seal portions have to be formed in a strictly high sizing precision.

In the aforementioned pressuring pump mechanism in another ball-point pen as disclosed in JP-A-2005-288794, the rear end opening portion of a bellows-shaped compression chamber which is made extensible and contractible in axial directions can be sealed at the front end portion of a rotor for rotating in association with the knock mechanism, and a seal member is disposed on the side of a front end opening portion, into which the medium containing tube of the pen refill unit is inserted, so that the sealing property in the compression chamber may be kept at the pressurizing time in the knocking operation of the knock mechanism.

In the aforementioned pressuring pump mechanism, however, the seal portion between the rotor and the rear end opening portion of the compression chamber acts as the rotational contact face on the axis, and the seal portion between the seal member on the side of the front end opening portion of the compression chamber and the medium containing tube acts as a contact face for the sliding contact in the axial directions. Thus, this pressuring pump mechanism has problems like the aforementioned ones of JP-A-2005-280119.

SUMMARY OF THE INVENTION

In view of the current practice thus far described, the present invention has an object to provide a pressurized pen which is enabled to enhance the sealing property of a compression chamber at a pressurizing time in the knocking operation of a knock mechanism and to improve the durability.

The aforementioned object is solved by the invention having the following structure, as described in the appended claims.

(1) A pressurized pen comprises: a pen refill unit loaded in a pen cylinder and having a pen tip disposed on a front end portion of a containing tube for containing a medium such as ink; and a pressuring pump mechanism for pressurizing the inside of a rear end opening portion of the medium containing tube in the pen refill unit, wherein the pressuring pump mechanism is associated with a knock mechanism disposed in the rear end portion of the pen cylinder such that said pen tip can be brought from the front end portion of the pen cylinder to the outside by the movement of said pen refill unit in axial direction. In the pressurized pen, the pressuring pump mechanism is constituted to include a pressure member having a front end opening portion communicating with the inside of the medium containing tube and a compression chamber made extensible and contractible in the axial directions, and a push member for coming into and out of contact with the rear end opening portion of said pressure member in the axial directions and for pushing the compression chamber of said pressure member in a gas-tight condition in a compressing direction, and said push member is enabled to move irrotationally toward the rear end opening portion of said pressure member in association with the pushing action of said knock mechanism.

(2) In the aforementioned item (1), the push member is formed to include a front end vent portion facing the inside of the compression chamber from the rear end opening portion of the pressure member, and a seal shoulder portion provided posterior to the front end vent portion and having a larger diameter than that of said front end vent portion and brought into abutment against the rear end opening portion of said pressure member by the pushing action of said knock mechanism thereby to keep the inside of said compression chamber gas-tight.

(3) In the aforementioned item (1) or (2), said push member is moved in association with the rotational drive of a rotor in a cam mechanism unit by the pushing and opening actions of a knock rod in the knock mechanism.

According to the invention, the following advantages can be attained.

According to a first aspect of the invention, the pressuring pump mechanism is constituted to include a pressure member having a front end opening portion communicating with the inside of the medium containing tube and a compression chamber made extensible and contractible in the axial directions, and a push member for coming into and out of contact with the rear end opening portion of the pressure member in the axial direction and for pushing the compression chamber of the pressure member in a gas-tight condition in a compressing direction, and the push member is enabled to move irrotationally toward the rear end opening portion of the pressure member in association with the pushing action of the knock mechanism. Therefore, the rotations on the axis and the contact faces to slide and contact in the axial directions can be eliminated from the sealing portions, so that the sealing portions can be prevented from looseness and wear and so that the sealing portions need not be strictly molded into high sizing precisions.

As a result, it is possible to enhance the sealing property of the compression chamber at a pressurizing time in the knocking operation of a knock mechanism and to improve the durability.

According to a second aspect of the invention, the push member is formed to include a front end vent portion facing the inside of the compression chamber from the rear end opening portion of the pressure member, and a seal shoulder portion provided posterior to the front end vent portion and having a larger diameter than that of the front end vent portion and brought into abutment against the rear end opening portion of the pressure member by the pushing action of the knock mechanism thereby keeping the inside of the compression chamber gas-tight. As a result, the rear end opening portion of the push member can be effectively choked at the seal shoulder portion to smoothen the pressurization of the inside of the medium containing tube.

According to a third aspect of the invention, the push member is moved in association with the rotational drive of a rotor in a cam mechanism unit by the pushing and opening actions of a knock rod in the knock mechanism. As a result, it is possible to smoothen the pressurization of the inside of the medium containing tube.

DESCRIPTION OF PREFERRED EMBODIMENT

In the following, the invention is described in detail based on a knock-type ball-point pen.

Figure 1:
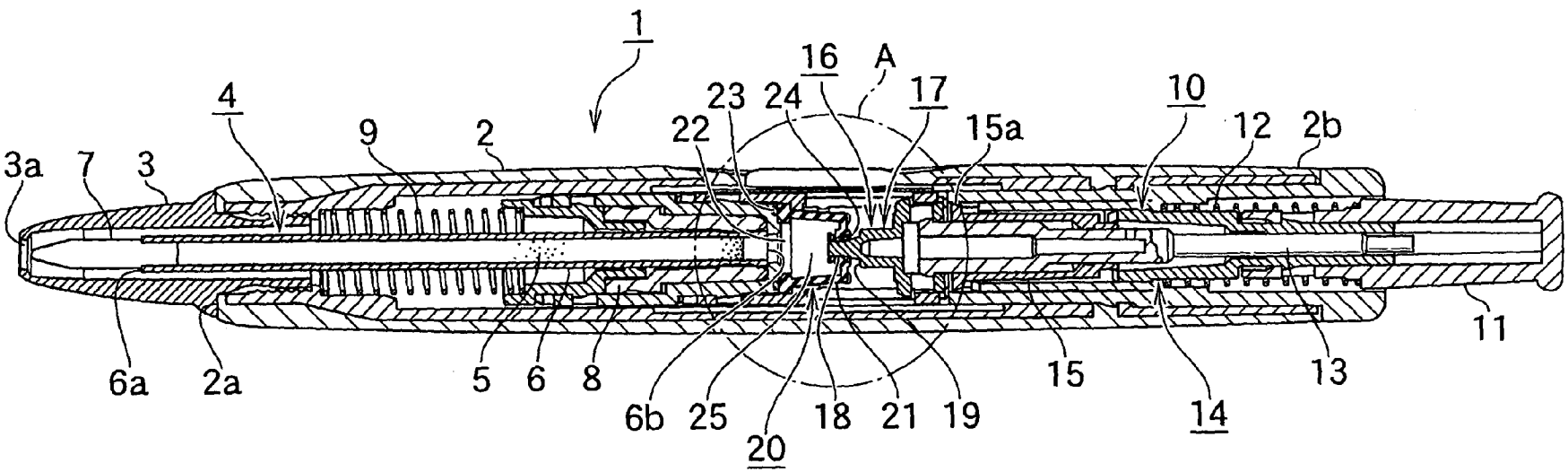
FIG. 1 is a sectional view of a knock-type ball-point pen in an unpressurized state and shows an embodiment of the invention.
Figure 2:
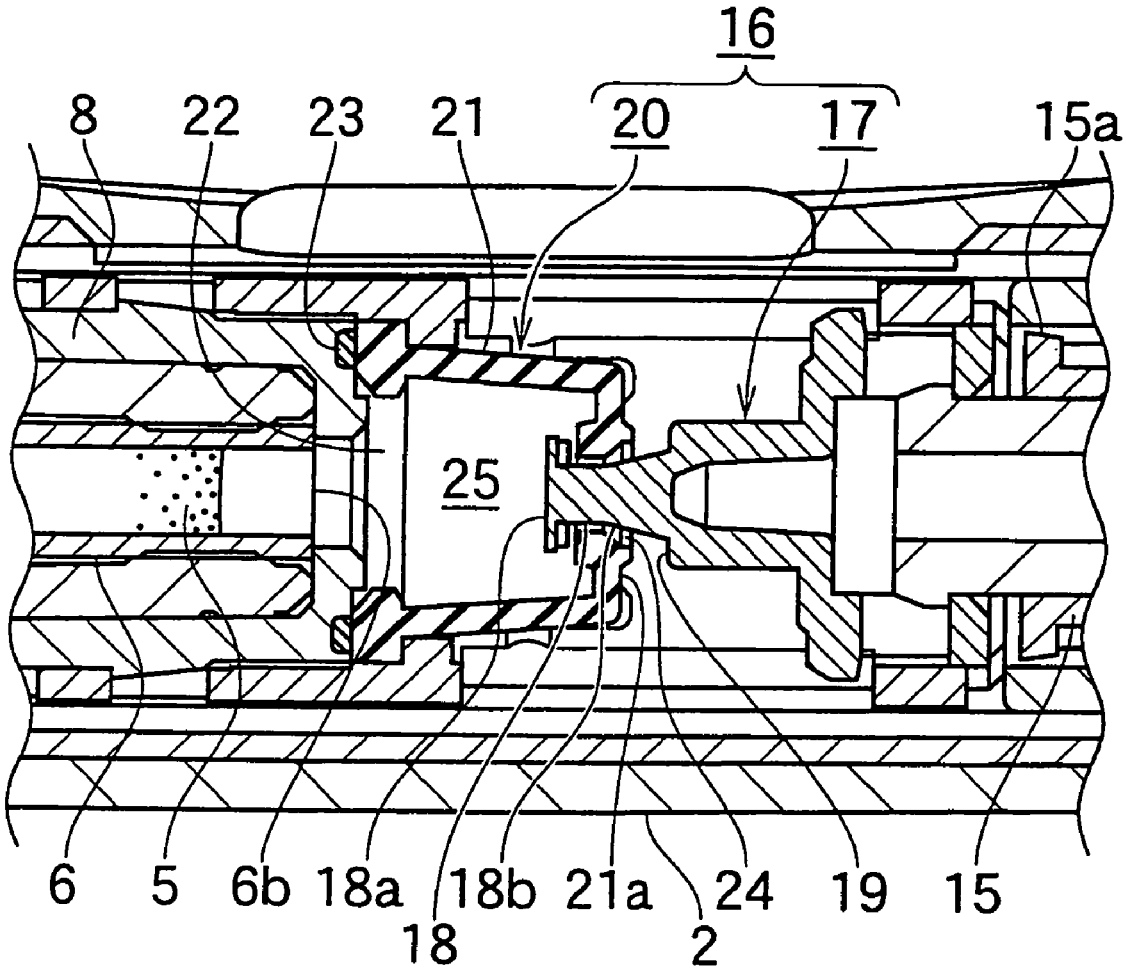
FIG. 2 is an enlarged sectional view of an essential portion in a circle A of FIG. 1.
Figure 3:
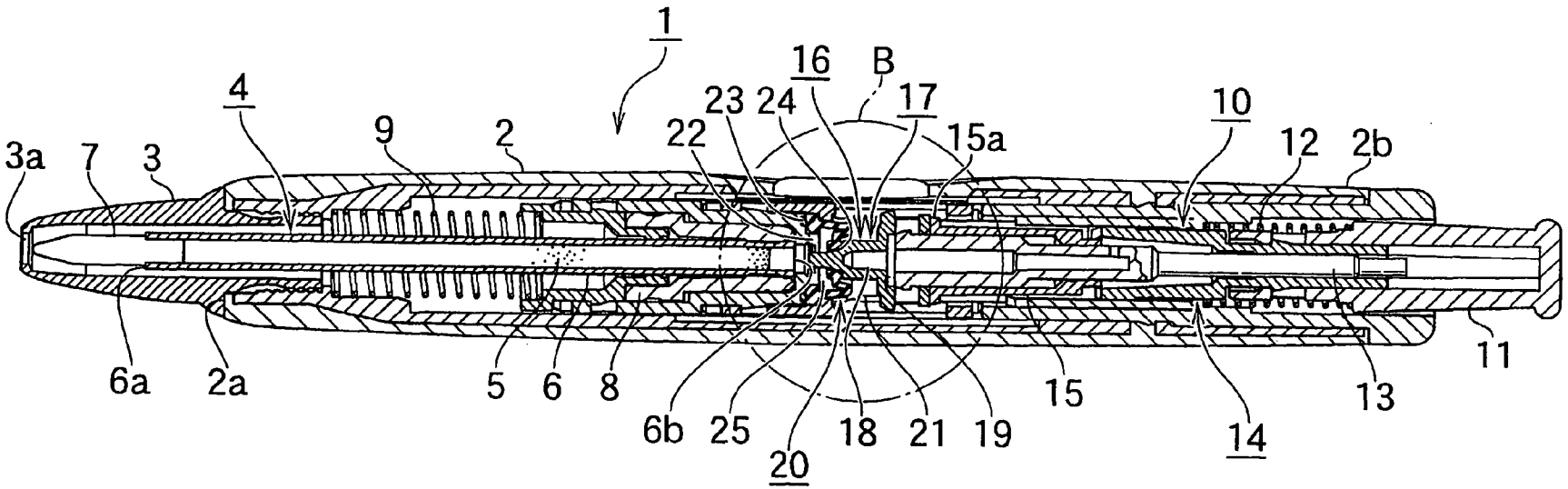
FIG. 3 is a sectional view of the knock-type ball-point pen in an initial pressurized state.
Figure 4:
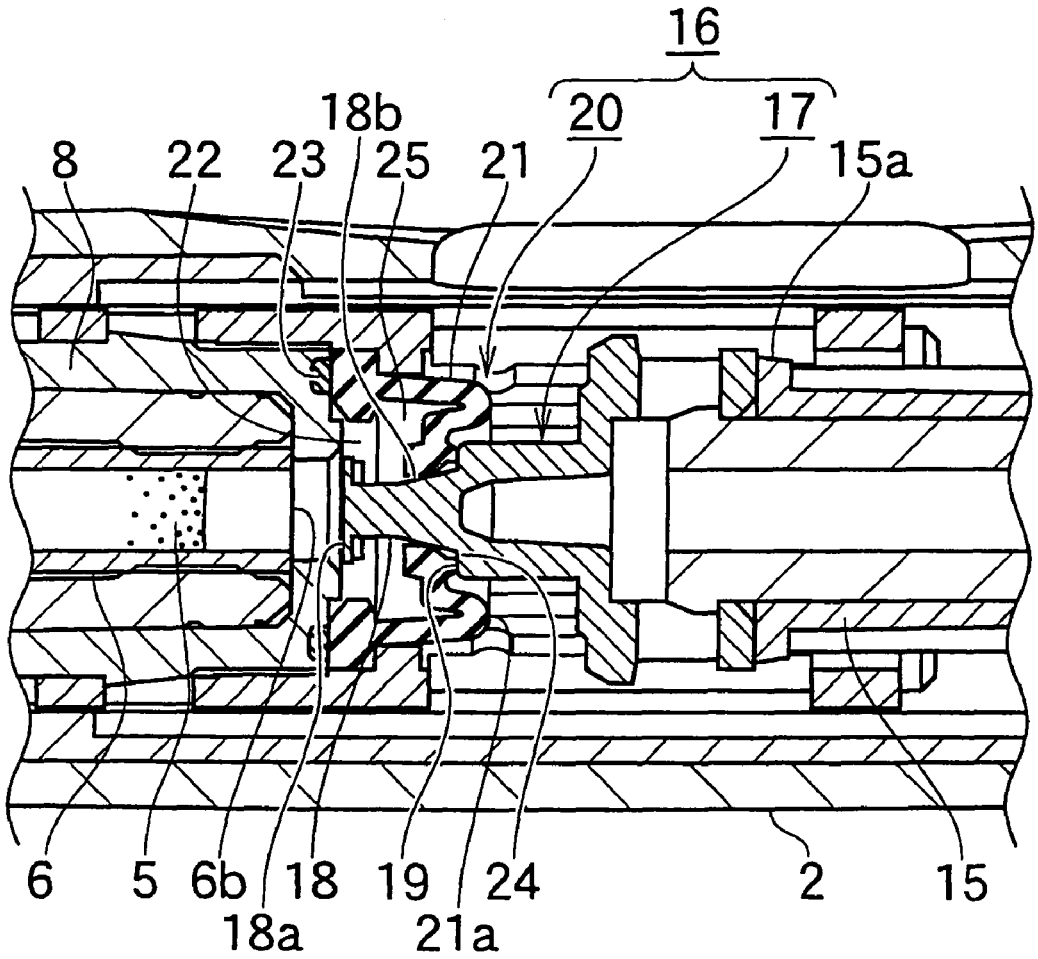
FIG. 4 is an enlarged sectional view of an essential portion in a circle B of FIG. 3.
Figure 5:
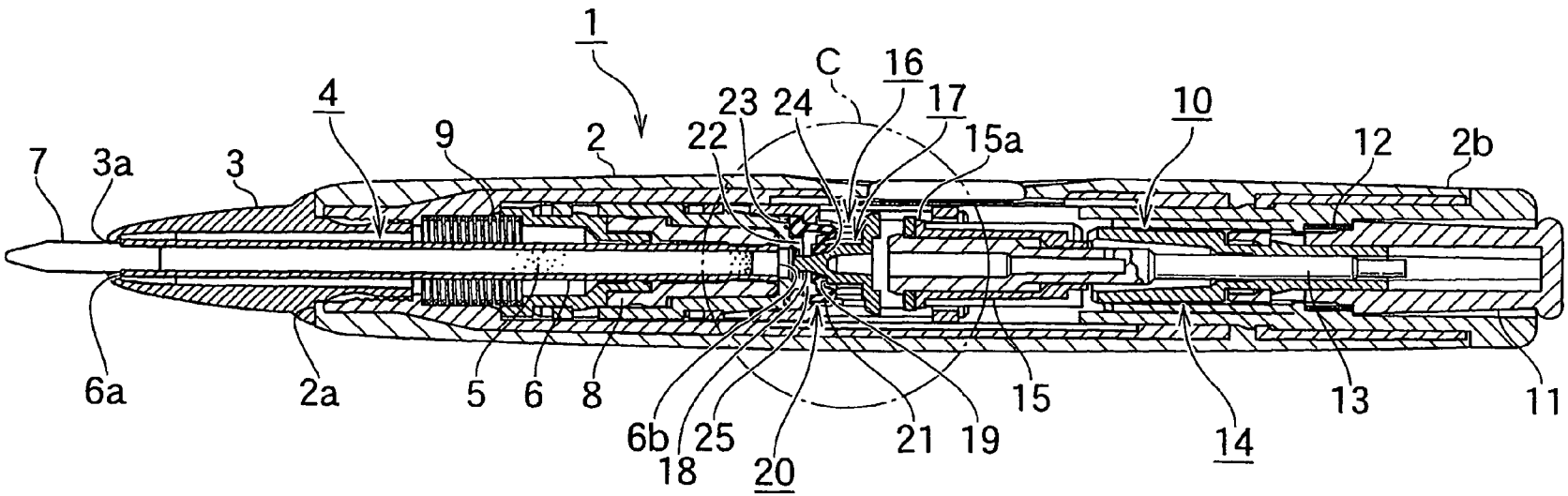
FIG. 5 is a sectional view of the knock-type ball-point pen in the maximum pressurized state.
Figure 6:
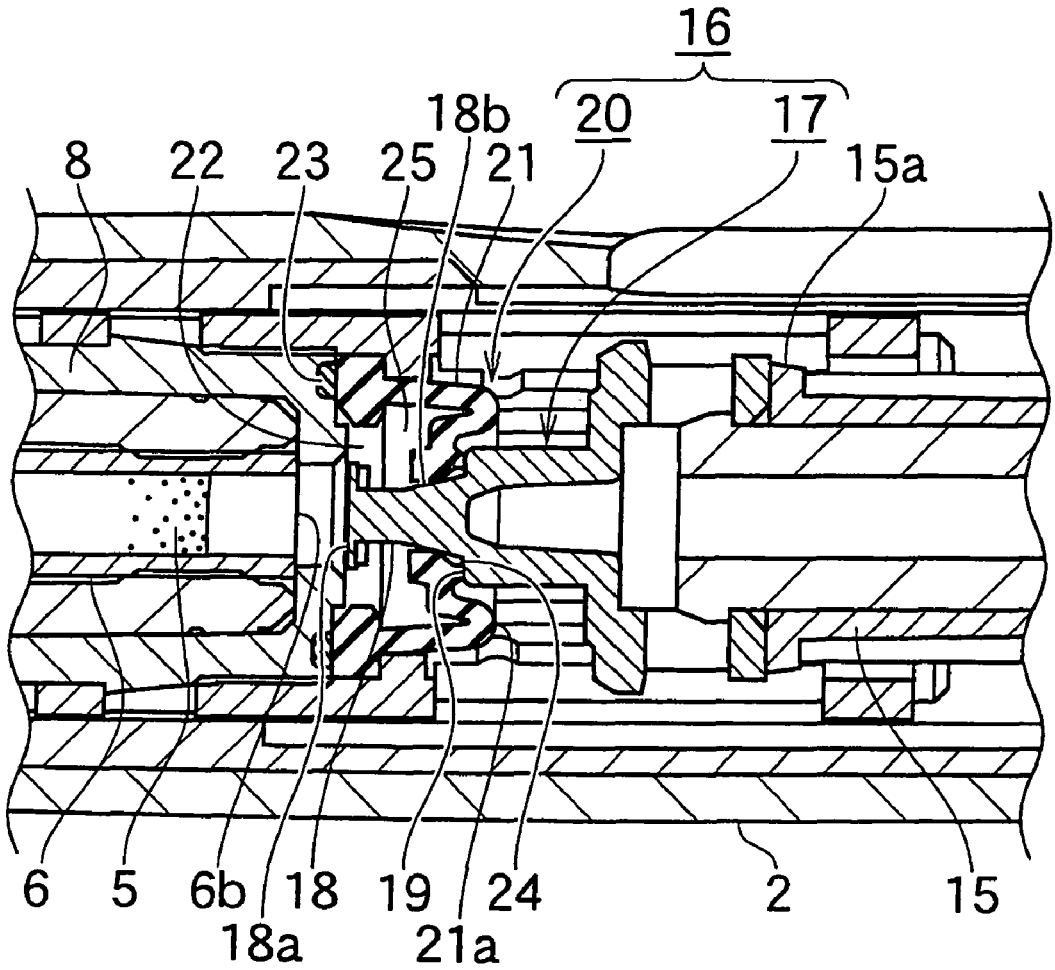
FIG. 6 is an enlarged sectional view of an essential portion in a circle C of FIG. 5.
Figure 7:
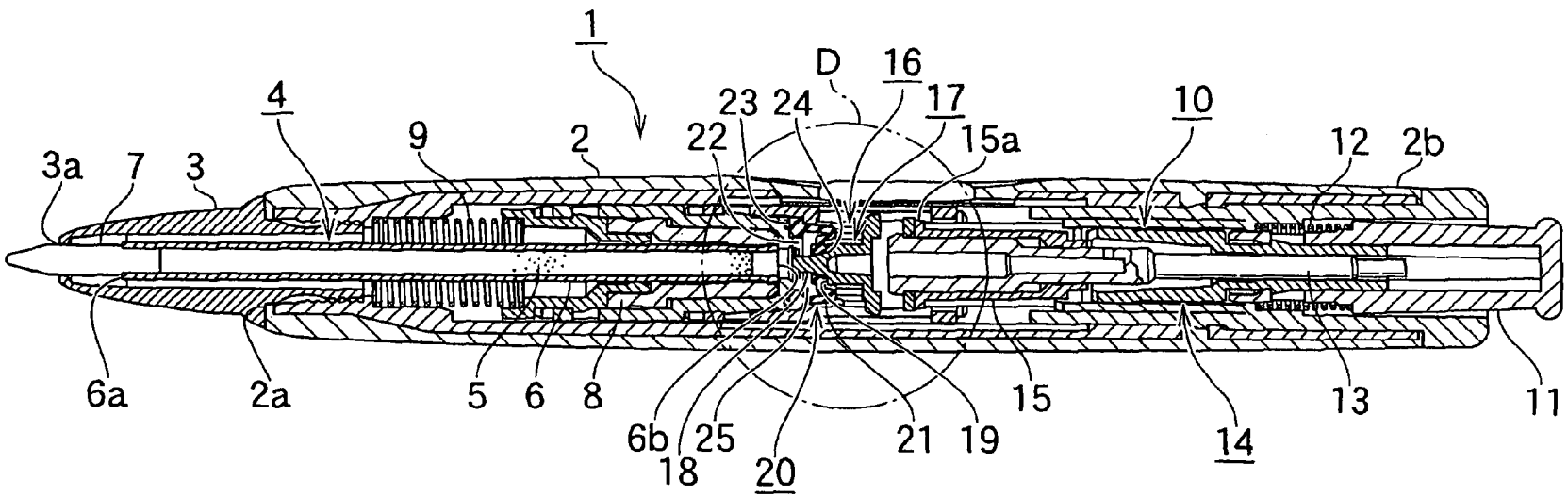
FIG. 7 is a sectional view of the knock-type ball-point pen in a writing state.
Figure 8:
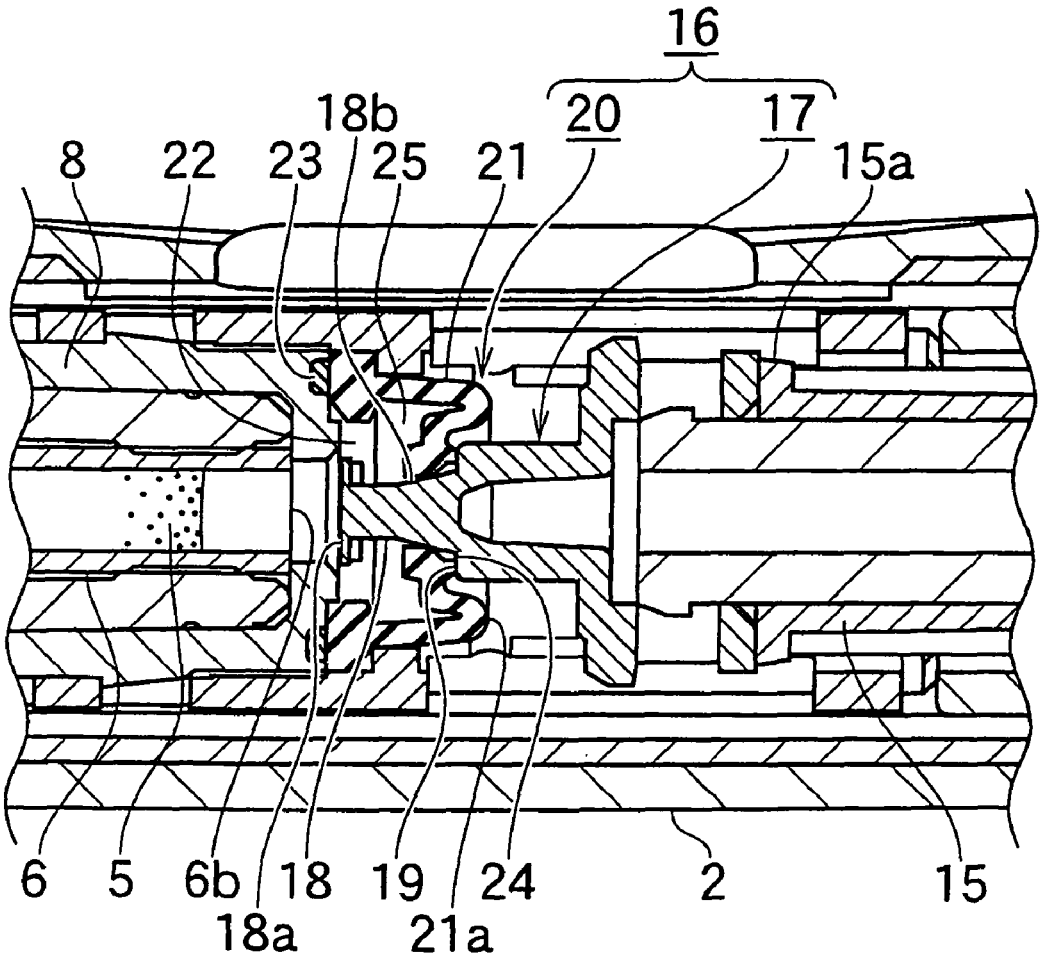
FIG. 8 is an enlarged sectional view of an essential portion in a circle D of FIG. 7.

FIG. 1 is a sectional view of a knock-type ball-point pen in an unpressurized state and shows one embodiment of the invention; FIG. 2 is an enlarged sectional view of an essential portion in a circle A of FIG. 1; FIG. 3 is a sectional view of the knock-type ball-point pen in an initial pressurized state; FIG. 4 is an enlarged sectional view of an essential portion in a circle B of FIG. 3; FIG. 5 is a sectional view of the knock-type ball-point pen in the maximum pressurized state; FIG. 6 is an enlarged sectional view of an essential portion in a circle C of FIG. 5; FIG. 7 is a sectional view of the knock-type ball-point pen in a writing state; and FIG. 8 is an enlarged sectional view of an essential portion in a circle D of FIG. 7.

Here in the drawings, the "left-hand side" with respect to the drawing sheet is called the "front", and the "right-hand side" is called the "back".

In a ball-point pen 1 according to the invention, as shown in FIG. 1, a pen holder is constituted of a pen cylinder 2 and a penpoint member or front member 3 screwed in a front end portion 2*a* of the pen cylinder 2, and the pen holder is loaded with a pen refill unit 4.

The pen refill unit 4 is constituted of an ink containing tube 6 charged with ink 5 as a writing medium, and a pen tip 7 mounted in the front end portion 6*a* of the ink containing tube 6.

The pen tip 7 is configured to protrude and retreat from a front end opening portion 3*a* of the front member 3 by the movements of the later-described pen refill unit 4.

The ink containing tube 6 is held on the side of a rear end opening portion 6*b* by a holder 8, which can slide in rear and front axial direction in the pen cylinder 2.

This holder 8 is so biased backward by a compression spring 9 that the pen tip 7 of the pen refill unit 4 can be retracted into the front member 3.

A knock mechanism 10 is assembled in the rear end portion 2*b* of the pen cylinder 2.

This knock mechanism 10 is constituted of a compression spring 12 for biasing the knock portion 11 backward so that the knock portion 11 may be able to protrude to the outside from the rear end portion 2*b* of the pen cylinder 2, a knock rod 13 for cooperating with the pushing action and the relieving action of the knock portion 11 against the biasing force of the compression spring 12, and a cam mechanism unit 14 for cooperating with this knock rod 13. This cam mechanism unit 14 is equipped with a rotor 15 for cooperating with the pushing action and the relieving action of the knock portion 11.

In this case, the spring force of the compression spring 12 is set to be lower than that of the compression spring 9.

Specifically, the knock mechanism 10 is a well-known mechanism (as referred to JP-B-34-7181, for example), which is caused to push the knock rod 13 against the biasing force of the compression spring 12 and to open the same by the knocking operation of the knock portion 11, thereby moving the rotor 15 of the cam mechanism unit 14 in the axial direction while rotating the rotor 15, so that the pen tip 7 may go into and out of the retracted state or the protruding state as the pen refill unit 4 moves.

A pressuring pump mechanism 16 is interposed between the rear end opening portion 6*b* of the ink containing tube 6 and the front end portion 15*a* of the rotor 15.

This pressuring pump mechanism 16 is constituted, as shown in FIG. 2, of a push member 17 for moving irrotationally and linearly in the axial direction in association with the rotational drive of the rotor 15, and a pressure member 20 interposed between the push member 17 and the rear end opening portion 6*b* of the ink containing tube 6 for deforming a later-described compression chamber 25 extensibly and contractively in the axial directions.

The push member 17 is formed by a front end vent portion 18 and a seal shoulder portion 19 stepped on the back of the front end vent portion 18 and made radially larger than the front end vent portion 18.

The front end of the front end vent portion 18 includes an expanded retaining portion 18*a* pressed from a rear end opening portion 24 of the later-described pressure member 20 thereby to face the compression chamber 25, and a vent passage 18*b* formed between the outer circumference of the expanded retaining portion 18*a* and the inner circumference of the rear end opening portion 24 in the aforementioned pressure member 20 and made capable of communicating with the ambient air along the axial direction.

The pressure member 20 is formed of an elastic cylinder member 21 made of an elastomer such as rubber.

This elastic cylinder member 21 brings a flange-shaped front end opening portion 22 into abutment, in a gas-tight condition through a seal ring 23, against the back face of the holder 8 containing the rear end opening portion 6*b* of the ink containing tube 6, and the rear end opening portion 24 protruding backward is opened in the center of a rear wall 21*a*.

The seal shoulder portion 19 of the push member 17 can come into and out of contact with the rear end opening portion 24 of the pressure member 20. In response to the pushing action of the knock portion 11 in the aforementioned knock mechanism 10, as shown in FIG. 3 and FIG. 4, the seal shoulder portion 19 is brought into abutment against the rear end opening portion 24 of the pressure member 20 by the forward movement of the push member 17 for moving irrotationally and linearly in the axial direction in association with the rotor 15, thereby forming the compression chamber 25, which is elastically extensible and contractible in the axial direction, and keeping the inside of the compression chamber 25 gas-tight.

Here is described the pressurizing action of the ball-point pen 1 in the present embodiment.

In the unpressurized state shown in FIG. 1 and FIG. 2, the knock portion 11 of the knock mechanism 10 is pushed forward at a half stage against the biasing force of the compression spring 12, as shown in FIG. 3 and FIG. 4. In association with this action, the knock rod 13 is moved forward so that the rotor 15 in the cam mechanism unit 14 is rotationally moved forward in a half-driven state.

In association with the forward rotational movement of the rotor 15, the push member 17 moves straight forward in an irrotational stage so that it brings the seal shoulder portion 19 of its front end portion into abutment against the rear end opening portion 24 of the pressure member 20 thereby closing the opening portion 24.

As a result, the communicating state between the outside and the vent passage 18*b* formed around the outer circumference of the front end vent portion 18 is blocked so that the rear wall 21*a* of the elastic cylinder member 21 in the pressure member 20 is pushed forward and elastically compressed and deformed while the inside of the compression chamber 25 being gas-tight, thereby pressurizing the inside of the compression chamber 25.

At this time, the spring force of the compression spring 12 is set lower than that of the compression spring 9 for biasing the pen refill unit 4 backward.

Even if the knock portion 11 is pushed to a half-stage, therefore, the pen refill unit 4 does not move forward.

As a result, the pen tip 7 is kept in the retracted state in the penpoint member 3.

Next, the knock portion 11 is pushed forward by a force stronger than the spring force of the compression spring 9, as shown in FIG. 5 and FIG. 6. In association with this pushing action, the knock rod 13 is moved forward so that the rotor 15 is further driven through the cam mechanism unit 14.

The push member 17 is linearly moved again forward in an irrotational state by the drive of the rotor 15 thereby compressing the inside of the compression chamber 25 in the gas-tight state, so that it forces the air in the compression chamber 25 toward the inside of the rear end opening portion 6*b* of the ink containing tube 6, thereby maximally pressurizing the rear end opening portion 6*b* of the ink containing tube 6.

At this time, the pushing force of the knock portion 11 is stronger than the spring force of the compression spring 9 for biasing the pen refill unit 4 backward. Therefore, the pen refill unit 4 moves forward, so that the pen tip 7 protrudes to the outside from the inside of the penpoint member 3 in the front end portion 2*a* of the pen cylinder 2 through the opening portion 3*a* at the front end portion 2*a* of the pen cylinder 2.

Next, the pushing action of the knock portion 11 is relieved. As shown in FIG. 7 and FIG. 8, only the knock rod 13 is caused to restore the desired retained position by the biasing force of the compression spring 12 so that the rotor 15 is retained at a drive position. As a result, the pen tip 7 keeps its protruding state, and the push member 17 is pushing the rear wall 21*a* of the elastic cylinder member 21 in the pressure member 20, so that a pressurized state is kept in the compression chamber 25.

At the pen using time, therefore, the inside of the ink containing tube 6 can be always kept under the pressurized state so that the writing operation with the pen tip being directed upward can be performed stably and reliably.

After the pen was used, the knock portion 11 is pushed again forward against the biasing force of the compression spring 12 thereby actuating the knock rod 13. Then, the retained state of the rotor 15 in the cam mechanism unit 14 is relieved so that the knock rod 13 is returned backward by the biasing force of the compression spring 12. At the same time, the rotor 15 is moved backward together with the push member 17 thereby restoring the initial position, as shown in FIG. 1 and FIG. 2.

Simultaneously with this, as the push member 17 returns backward, the rear wall 21*a* of the elastic cylinder member 21 in the pressure member 20 is pulled backward by the expanded retaining portion 18*a* of the front end vent portion 18, thereby restoring the extending state from the compressed state. The seal shoulder portion 19 is released again from the rear end opening portion 24 in accordance with the backward returning movement of the push member 17, so that the vent passage 18*b* of the front end vent portion 18 is opened. As a result, the compression chamber 25 in the ink containing tube 6 and in the elastic cylinder member 21 comes into the vented state to relieve the pressurized state in the ink containing tube 6.

As a result, the knocking operation can be easily performed with a small force thereby providing the pressurized pen having an excellent using feel.

In this embodiment, more specifically, the push member 17 can be irrotationally moved toward the rear end opening portion 24 of the pressure member 20 in association with the pushing action of the knock mechanism 10. Therefore, the rotations on the axis and the contact faces to slide and contact in the axial directions can be eliminated from the sealing portions of the seal shoulder portion 19 of the push member 17 and the rear end opening portion 24 of the pressure member 20, so that the sealing portions can be prevented from looseness and wear and so that the sealing portions need not be strictly molded into high sizing precisions.

As a result, it is possible to enhance the sealing property of the compression chamber 25 in the pressure member 20 and to improve the durability.

What is claimed is:

1. A pressurized pen comprising: a pen refill unit loaded in a pen cylinder and having a pen tip disposed in the front end portion of a containing tube for containing a medium such as ink; and a pressuring pump mechanism for pressurizing the inside of the rear end opening portion of the medium containing tube in the pen refill unit, wherein the pressuring pump mechanism is associated with a knock mechanism disposed in the rear end portion of the pen cylinder such that said pen tip can be brought from the front end portion of the pen cylinder to the outside by the movements of said pen refill unit in axial direction, wherein said pressuring pump mechanism is constituted to include a pressure member having a front end opening portion communicating with the inside of the medium containing tube and a compression chamber made extensible and contractible in the axial directions, and a push member for coming into and out of contact with the rear end opening portion of said pressure member in the axial directions and for pushing the compression chamber of said pressure member in a gas-tight condition in a compressing direction;

said push member is enabled to move toward the rear end opening portion of said pressure member in association with the pushing action of said knock mechanism, wherein the push member is formed to include a front end vent portion facing the inside of the compression chamber from the rear end opening portion of the pressure member, and a seal shoulder portion provided posterior to the front end vent portion and having a larger diameter than that of said front end vent portion and brought into abutment against the rear end opening portion of said pressure member by the pushing action of said knock mechanism thereby to keep the inside of said compression chamber gas-tight.

2. A pressurized pen according to claim 1, wherein said push member is moved in association with the rotational drive of a rotor in a cam mechanism unit by the pushing and opening actions of a knock rod in the knock mechanism.

3. A pressurized pen comprising: a pen, refill unit loaded in a pen cylinder and having a pen tip disposed in the front end portion of a containing tube for containing a medium such as ink; and a pressuring pump mechanism for pressurizing the inside of the rear end opening portion of the medium containing tube in the pen refill unit, wherein the pressuring pump mechanism is associated with a knock mechanism disposed in the rear end portion of the pen cylinder such that said pen tip can be brought from the front end portion of the pen cylinder to the outside by the movements of said pen refill unit in axial direction, wherein said pressuring pump mechanism is constituted to include a pressure member having a front end opening portion communicating with the inside of the medium containing tube and a compression chamber made extensible and contractible in the axial directions, and a push member for coming into and out of contact with the rear end opening portion of said pressure member in the axial directions and for pushing the compression chamber of said pressure member in a gas-tight condition in a compressing direction;

said push member is enabled to move toward the rear end opening portion of said pressure member in association with the pushing action of said knock mechanism;

the push member is formed to include a front end vent portion facing the inside of the compression chamber from the rear end opening portion of the pressure member and further forms a seal shoulder portion provided posterior to the front end vent portion having a larger diameter than that of said front end vent portion and is configured and operable to be brought into abutment against the rear end opening portion of said pressure member by the pushing action of said knock mechanism thereby to cause the inside of said compression chamber to be gas-tight wherein a front end of said front end vent portion includes an expanded retaining portion to face said compression chamber.

4. A pressurized pen according to claim 3, wherein said push member is moved in association with the rotational drive of a rotor in a cam mechanism unit by the pushing and opening actions of a knock rod in the knock mechanism.

5. A pressurized pen comprising: a pen refill unit loaded in a pen cylinder and having a pen tip disposed in the front end portion of a containing tube for containing a medium such as ink; and a pressuring pump mechanism for pressurizing the inside of the rear end opening portion of the medium containing tube in the pen refill unit, wherein the pressuring pump mechanism is associated with a knock mechanism disposed in the rear end portion of the pen cylinder such that said pen tip can be brought from the front end portion of the pen cylinder to the outside by the movements of said pen refill unit in axial direction, wherein said pressuring pump mechanism is constituted to include a pressure member having a front end opening portion communicating with the inside of the medium containing tube and a compression chamber made extensible and contractible in the axial directions, and a push member for coming into and out of contact with the rear end opening portion of said pressure member in the axial directions and for pushing the compression chamber of said pressure member in a gas-tight condition in a compressing direction;

said push member is enabled to move toward the rear end opening portion of said pressure member in association with the pushing action of said knock mechanism;

the push member is formed to include a front end vent portion facing the inside of the compression chamber from the rear end opening portion of the pressure member and further forms a seal shoulder portion provided posterior to the front end vent portion having a larger diameter than that of said front end vent portion and is configured and operable to be brought into abutment against the rear end opening portion of said pressure member by the pushing action of said knock mechanism thereby to cause the inside of said compression chamber to be gas-tight wherein a front end of said front end vent portion includes an expanded retaining portion to face said compression chamber wherein the front end of said front end vent portion further includes a vent passage formed between the outer circumference of said expanded retaining portion and the inner circumference of a rear end opening portion in said pressure member and is configured and operable to communicate with the ambient air along the axial direction.

6. A pressurized pen according to claim 5, wherein said push member is moved in association with the rotational drive of a rotor in a cam mechanism unit by the pushing and opening actions of a knock rod in the knock mechanism.

* * * * *